US010701985B2

(12) United States Patent
Cano

(10) Patent No.: US 10,701,985 B2
(45) Date of Patent: Jul. 7, 2020

(54) SHAPEWEAR GARMENT, SHAPEWEAR GARMENT SYSTEM, AND METHOD OF MANUFACTURE THEREOF

(71) Applicant: Jobany Cano, Belleville (CO)

(72) Inventor: Jobany Cano, Belleville (CO)

( * ) Notice: Subject to any disclaimer, the term of this patent is extended or adjusted under 35 U.S.C. 154(b) by 241 days.

(21) Appl. No.: 15/627,986

(22) Filed: Jun. 20, 2017

(65) Prior Publication Data

US 2017/0367414 A1 Dec. 28, 2017

Related U.S. Application Data

(60) Provisional application No. 62/353,266, filed on Jun. 22, 2016.

(51) Int. Cl.

| | |
|---|---|
| ***A41B 11/14*** | (2006.01) |
| ***A41B 9/08*** | (2006.01) |
| ***A41B 9/16*** | (2006.01) |
| ***A41C 3/00*** | (2006.01) |
| ***A41C 3/12*** | (2006.01) |
| ***A41D 1/06*** | (2006.01) |

(52) U.S. Cl.

CPC ..... *A41B 11/14* (2013.01); *A41B 9/08* (2013.01); *A41B 9/16* (2013.01); *A41C 3/0007* (2013.01); *A41C 3/12* (2013.01); *A41D 1/06* (2013.01)

(58) Field of Classification Search

CPC . A41C 1/08; A41F 15/02; A41B 11/14; A41B 9/08

USPC ..... 2/109, 107

See application file for complete search history.

(56) References Cited

U.S. PATENT DOCUMENTS 1,456,301 A * 5/1923 Diefenbacher ..... A41F 15/02 24/354
1,936,127 A * 11/1933 Dunlevy ..... A41F 15/002 24/312
2,582,166 A * 1/1952 Rosner ..... A41C 1/06 450/8
2,595,139 A * 4/1952 Hart ..... A41F 15/002 450/28
2,984,879 A * 5/1961 Budd ..... A41F 15/02 24/199
3,077,650 A * 2/1963 Horne ..... A41F 15/002 24/200
3,222,688 A * 12/1965 Rosenzweig ..... A41F 15/002 2/323
3,276,088 A * 10/1966 Block ..... A41F 15/002 24/265 A
3,712,308 A * 1/1973 Herbener ..... A41B 9/005 450/95
5,667,422 A * 9/1997 Erwin ..... A41B 9/06 2/73

(Continued)

*Primary Examiner* — Alissa J Tompkins
*Assistant Examiner* — Brieanna Szafran

(57) ABSTRACT

The present invention is directed to a shapewear garment, a shapewear garment system, and methods of manufacture thereof. The shapewear garments are configured to provide various levels of compression on the body of a wearer for shaping desired areas of the wearer's body. In an exemplary embodiment, the shapewear garment system is formed of two shapewear garments, with one of the shapewear garments being applied on the body of the wearer first for conditioning the body of the wearer to receive the other of the shapewear garments over the one shapewear garment in overlapping relationship thereof.

17 Claims, 18 Drawing Sheets

(56) References Cited

U.S. PATENT DOCUMENTS

| | | | | |
|---|---|---|---|---|
| 2011/0237157 | A1* | 9/2011 | Scott | A41C 3/0021 450/41 |
| 2011/0244757 | A1* | 10/2011 | Mays | A41C 3/0021 450/31 |
| 2016/0073718 | A1* | 3/2016 | McKinlay | A41D 31/00 450/95 |
| 2016/0106157 | A1* | 4/2016 | Bickley | A41B 9/12 2/400 |

* cited by examiner

SHAPEWEAR GARMENT, SHAPEWEAR GARMENT SYSTEM, AND METHOD OF MANUFACTURE THEREOF

RELATED APPLICATION

This application claims priority from U.S. provisional patent application No. 62/353,266, filed Jun. 22, 2016, which is incorporated herein by reference in its entirety.

TECHNICAL FIELD

The present invention relates generally to garments, and more particularly, to shapewear garments, a shapewear garment system, and methods of manufacturing the same.

BACKGROUND

Compression or shaping garments are used to provide support and improve the appearance of the wearer. Better known today as shapewear, these shaping garments include body suits, girdles and corsets. However, conventional shaping garments suffer from various disadvantages. Conventional shaping garments which are adjusted sufficiently to enhance its body sliming function are extremely difficult to put on and take off. For example, shapers or corsets of high compression generally use antique systems that include rods, hooks and closures, or combinations thereof, which are very difficult to apply and in many instances generate marks on the wearer's skin which last for a long time.

Conventional shaping garments of high compression utilize excessive reinforcements, thick seams and other visible components which reveal that the wearer is using such shaping garments when wearing a tightly adjusted exterior garment. That is, such conventional shaping garments are conspicuous, thereby revealing that the user is using such shaping garments.

Conventional shaping garments which are easy to put on and take off fail to apply sufficient compression to the wearer's body to achieve significant changes to the form of the wearer's body and, therefore, are unable to produce a more fashionable slim figure and to significantly enhance the natural curves of the wearer's body.

Therefore, it is desirable to provide shapewear garments and a shapewear garment system which are easy to apply and which are effective in enhancing the natural curves of the wearer's body while maintaining long-term comfort.

SUMMARY

In a first aspect, the present invention is directed to a shapewear/shaping garment formed of a plurality of panels and shoulder strap portions configured to provide targeted compression to and firm up the wearer's torso, legs and buttocks. In an exemplary embodiment, the shapewear garment is made of a stretchable fabric using polyester or nylon as a base material combined with spandex in an amount of 15% or higher. One of the panels of the shapewear garment forms a central reinforcement portion that is configured to flatten the abdomen up to the pelvic zone of the wearer's body. In one embodiment, the central reinforcement portion is a fabric (e.g., polyester fabric) woven with a plain weave that does not stretch four ways (i.e., is not a 4-way stretch fabric). By its configuration and design, as well as the fabric material used, the shapewear garment can be easily and rapidly applied to the wearer's body. The shapewear garment smoothens rolls on the wearer's body produced by fat of adipose tissue, as well as smoothens the wearer's skin to thereby reduce cellulite.

The configuration of the shapewear garment according to the first aspect of the present invention allows it to be used by the wearer as a standalone shaping (foundation) garment to provide the functionalities and benefits as described above. The shapewear garment according to the first aspect of the present invention is also configured for use as a low compression shapewear garment that can be easily applied first to the wearer's body to condition the wearer's body for receiving a high compression shapewear garment so that when applied to the wearer's body, the combination of the two shapewear garments apply a higher compression to the wearer's body than when the low compression shapewear garment is applied to the wearer's body by itself (i.e., without the high compression shapewear garment). One example of the use of the shapewear garment according to the first aspect of the present invention as a low compression shapewear garment as part of a shapewear garment system according to a second aspect of the present invention is described below.

In a second aspect, the present invention provides a shapewear garment system comprised of two shapewear garments configured to be worn together in overlapping relation to one another over a wearer's body and designed to change the wearer's shape, produce a more fashionable slim figure, and enhance the natural curves of the body. The shapewear garment system is effective in producing a smooth fit that flattens the wearer's figure while maintaining long-term comfort.

The two shapewear garments forming the shapewear garment system consist of a first shapewear garment (hereinafter "Part A") configured to be applied first on the wearer's body, and a second shapewear garment (hereinafter "Part B") configured to be applied directly on Part A in overlying relationship thereto. The shapewear garment system is characterized by the dual advantage of low compression being applied on the wearer's body when only Part A is applied, whereas high compression is applied on the wearer's body when both Parts A and B are applied on the wearer's body.

According to a feature of the present invention, each of the low and high compression shapewear garments of the shapewear garment system are made of a stretchable fabric material combined with spandex, with the high compression shapewear garment having a higher content of spandex than the low compression shapewear garment. In one exemplary embodiment, Part A may be in the form of the shapewear garment such as described above for the shapewear garment according to the first aspect of the present invention, with Part A being made of a stretchable fabric using polyester or nylon as a base material combined with spandex in an amount of 15% or higher, and Part B is made of a stretchable fabric using polyester or nylon as a base material combined with spandex in an amount of 30% or higher.

According to the present invention, Parts A and B form an integral shapewear garment system in which Part A functions to condition the wearer's body to prepare the wearer's body to receive Part B. That is, while Part A can be used (i.e., applied to the wearer's body) as a standalone shapewear garment, Part B can only be applied to the wearer's body due to the conditioning of the wearer's body by Part A. In this regard, Part A functions to prepare or prime the wearer's body to receive Part B. Using only Part A, the wearer's body is subjected to low compression, whereas the wearer's body is subjected to high compression when both Parts A and B are used. The conditioning effect of Part A allows Part B to be easily applied on and removed from the wearer's body. In this regard, Part A prepares the wearer's body by eliminating friction so that Part B can be gently slid over Part A. That is, without the conditioning effect of Part A on the wearer's body, it would be difficult, if not impossible, to slide Part B directly over the wearer's body, in overlaying relationship to Part A, due to a high resistance generated by Part B directly contacting the skin of the wearer's body.

During use, the shapewear garment system formed of Parts A and B does not generate marks on the wearer's torso. The shapewear garment system effectively flattens the wearer's abdomen to the pelvic zone, smoothens fat bulges or rolls in the torso, back and leg areas of the wearer's body, and lifts and rounds the wearer's buttocks in a highly effective manner. The material forming Parts A and B of the shapewear garment systems is sufficiently thin in order to maintain the wearer's body cool and prevent an increase in the clothing size of the wearer. The shapewear garment system is not noticeable on the wearer's body, even when worn under tightly adjusted outer clothing.

As described above, Part B can be easily slid over the wearer's body, in overlaying relationship to Part A, as a result of the conditioning effect by Part A on the wearer's body. Part B is configured to further increase the compression applied on the wearer's body by Part A, giving form to the torso, legs, thighs, hips and buttocks. When applied over Part A, Part B effectively functions to lift the buttocks by applying pressure to areas of the buttocks surrounding the central part of the buttocks already firmed up by Part A, thereby causing the wearer's buttocks to project and achieve enhanced roundness. Part B even further smoothens rolls on the wearer's body produced by fat of adipose tissue as well as cellulite marks. The fabric material forming Part B is characterized by highly thin edges which do not require terminating seams or reinforcements.

Each of Parts A and B forming the shapewear garment system includes shoulder straps for supporting Parts A and B on the wearer's shoulders. The shoulder straps for each of Parts A and B include adjustable fasteners for adjusting (e.g., lengthening or shortening) the straps during wear of Parts A and B. During wear of Parts A and B, the shoulder straps of Part B are positioned so as to rest on the respective shoulder straps of Part A. According to a feature of the present invention, one of the adjustable fasteners of each strap of Part A includes means for positioning, guiding and preventing the corresponding strap of Part B from sliding out of position relative to the strap of part A. In an exemplary embodiment, the positioning, guiding and preventing means comprise hook portions of the adjustable fastener.

According to another feature of the present invention, each of the shoulder straps of Part A has a strap portion defining a shoulder pad formed of two layers of fabric with a filler interposed therebetween. The shoulder pads are configured for cushioning the pressure applied by the straps of Part B during use of the shapewear garment system. In an exemplary embodiment, the filler used for the shoulder pads is made of foam, such as styrene butadiene rubber (SBR).

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown.

DETAILED DESCRIPTION

Figure 1:
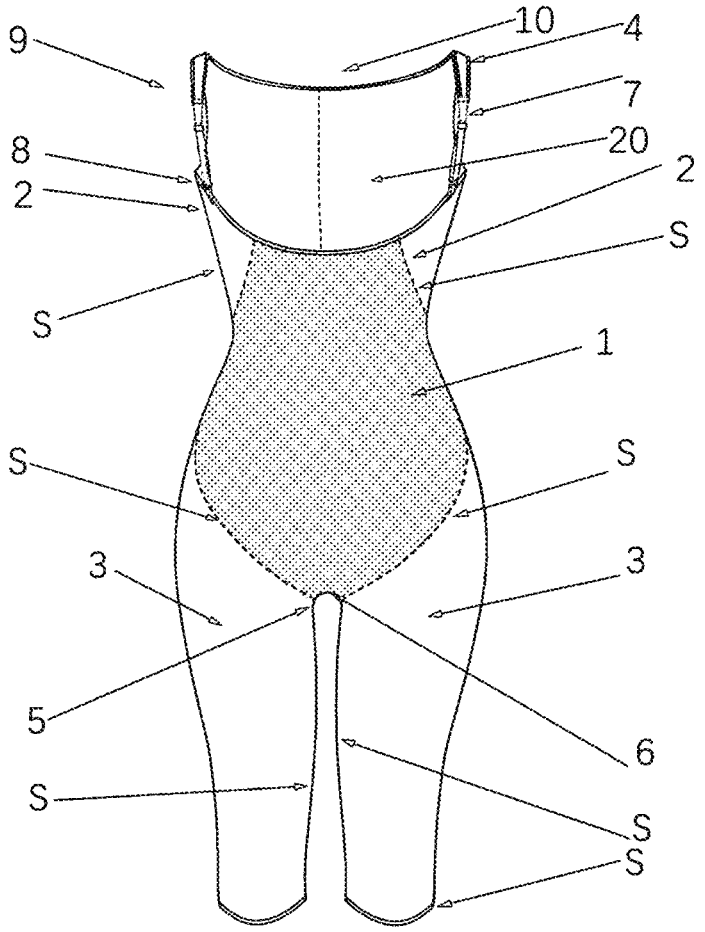
FIG. 1 is a front view of a shapewear garment according to an exemplary embodiment of the present invention. The shapewear garment shown in FIG. 1 can be used alone by the wearer, or it can be used as part (Part A) of a shapewear garment system according to the present invention.
Figure 2:
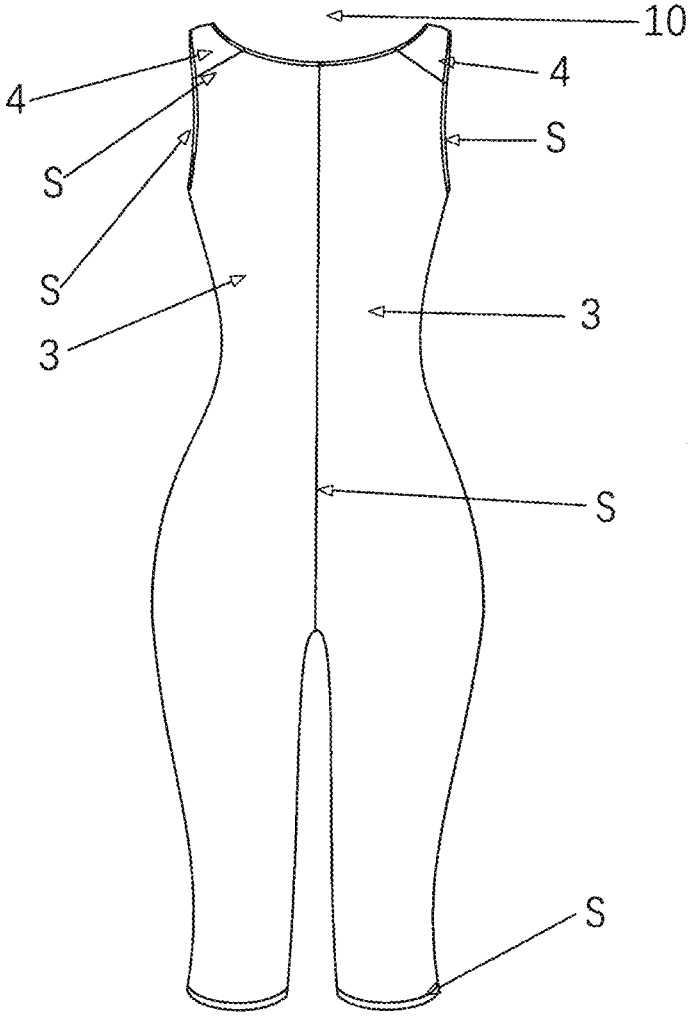
FIG. 2 is a rear view of the shapewear garment shown in FIG. 1.
Figure 3:
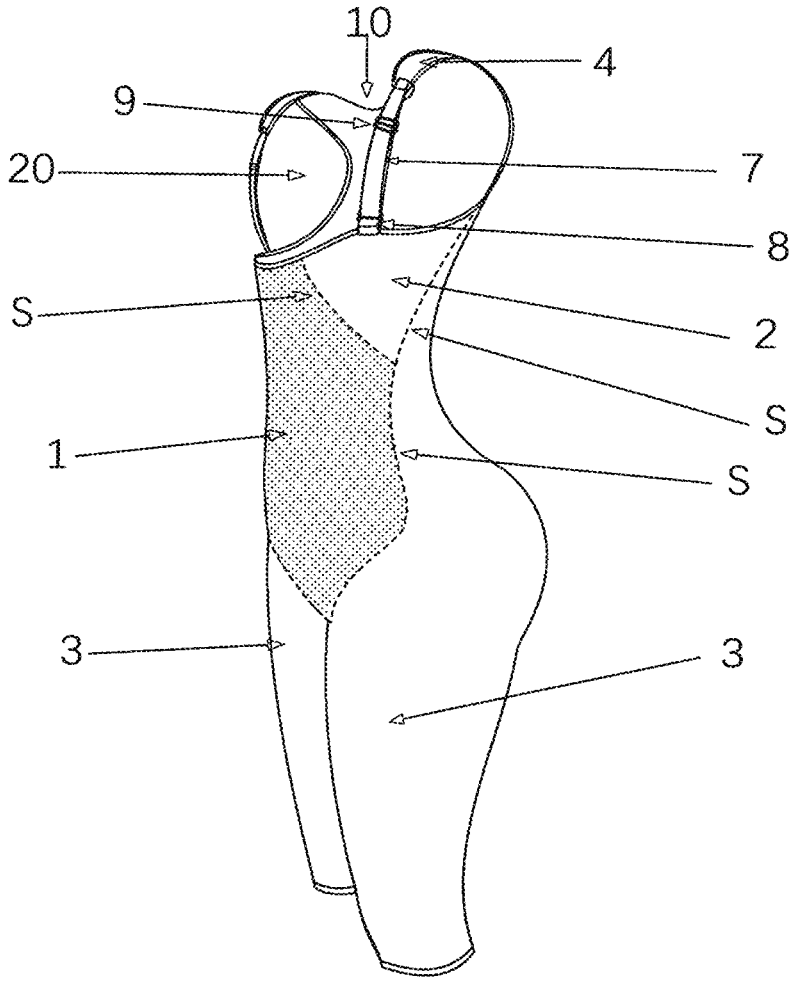
FIG. 3 is a front perspective view of the shapewear garment shown in FIG. 1.

The present invention now will be described more fully hereinafter with reference to the accompanying drawings, in which exemplary embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

For convenience of description, the terms "upper", "lower", "top", "bottom", "front", "rear", "right", "left", "side" and words of similar import will have reference to the various members and components of the shapewear garment of the present invention as arranged and illustrated in the figures of the drawings and described hereinafter in detail.

In FIGS. 1-15 described below, the shapewear garments are shown applied on a mannequin illustrating the shapewear garments in use with respect to a wearer's body. It is understood, however that the mannequin does not form part of the inventions described herein FIGS. 1-4 show a front view, rear view, front perspective view, and rear perspective view, respectively, of a shapewear garment (hereinafter also "shaper") according to an exemplary embodiment of the present invention. The shaper is applied on a ¾ armless and headless female mannequin 10, representative of a wearer of the shaper, for the purpose of illustrating the various features of the shaper according to the present invention as further described below. In the various figures, numeral 20 denotes a redacted portion of the mannequin for the purpose of minimizing exposure of breast parts of the mannequin. It is understood that such redacted portions does not form part of the invention.

As shown in FIGS. 1-4, the shaper is formed of a plurality of panels or parts 1-3, 5-6 and shoulder straps with portions 4, 7 and adjustable fasteners 8, 9, all of which are configured and assembled together to provide targeted compression to and firm up the wearer's torso, legs and buttocks. Reference numerals 1-3 and 5-6 denote a central part, top side parts, left and right side parts, and crotch parts, respectively, which are connected (e.g., by sewing) together by seams and tapes, generally designated at S. The parts 1-3 and 5-6 of the shaper are configured to contain the back, waist, buttocks and hips of the wearer, and form two leg portions configured to encircle the respective leg of the wearer to at least below the knee. An upper portion of the front side of the shaper (FIG. 1) defined by central part 1 and top side parts 2 is shaped to support undersides of the breasts of the wearer while leaving the breasts exposed. Crotch parts 5, 6 are connected together to define a crotch opening through the shaper. As shown in FIGS. 1-4, the central part 1 is connected to the top side parts 2 which are in turn connected to the left and right side parts 3. Crotch parts 5-6 are also connected to the left and right side parts 3.

Referring to FIGS. 3-6, the strap portions 4 of the shoulder straps have first ends connected (e.g., sewn) to the corresponding left and right side parts 3 and opposite second ends. The strap portions 7 of the shoulder straps have first ends connected (e.g., sewn) to the respective second ends of the strap portions 4, and having second ends connected to the corresponding top side parts 2. Each of the shoulder straps is also provided with the adjustable fasteners 8, 9 for adjusting (e.g., lengthening or shortening) the shoulder straps during wear. The adjustable fastener 8 is assembled to the second end of the strap portion 7. A clip is sewn to a seam S proximate a central portion of the corresponding top side part 2 for releasable connection to the adjustable fastener 8. In this embodiment, the adjustable fastener 8 has a closed loop portion through which the strap portion 7 is received, and a hook portion extending from the closed loop portion for releasable connection to the clip on the corresponding top side part 2 of the shaper.

Figure 6:
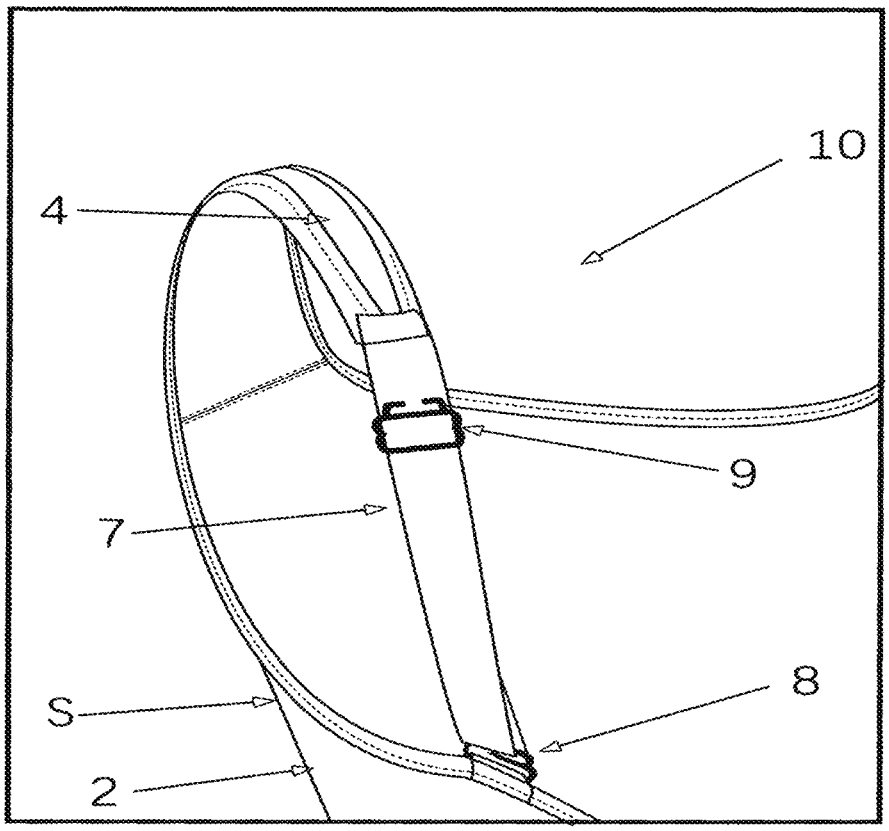
FIG. 6 is an enlarged front view of a portion of the shapewear garment (Part A) illustrating details of the shoulder strap.
Figure 16:
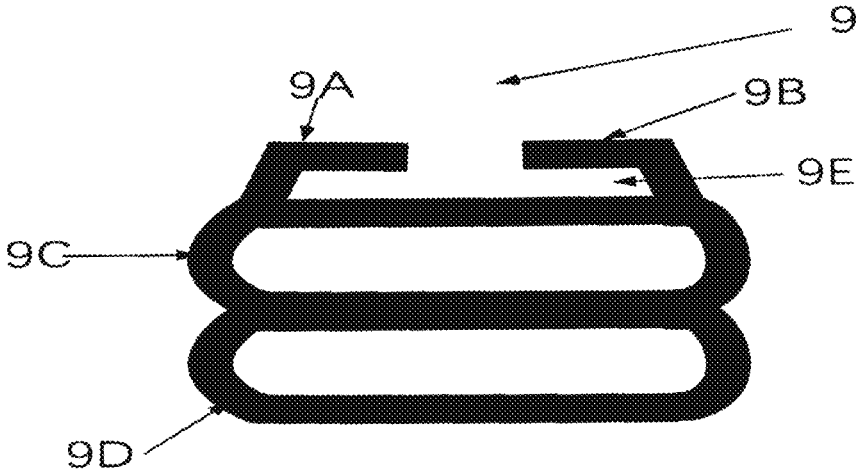
FIG. 16 is a plan view showing an exemplary embodiment of an adjustable fastener for the shoulder straps of the shapewear garment system according to the invention.

FIGS. 6 and 16 show an exemplary embodiment of the adjustable fastener 9 according to the present invention. The adjustable fastener 9 is formed two adjoining closed loop portions 9C, 9D and two hook portions 9A, 9B extending from loop portion 9C. The hook portions 9A, 9B project in confronting relation to one another to form an open slot 9E. The closed loop portions 9C, 9D are configured to receive the strap portion 7 for length adjustment thereof during use of the shaper. As described below with reference to the shapewear garment system according to the present invention, the hook portions 9A, 9B are configured to position and guide the shoulder strap of a second shapewear garment over the corresponding strap portion 7 of the shaper for preventing the shoulder strap of the second shapewear garment from sliding out of position relative to the strap portion 7.

Figure 5:
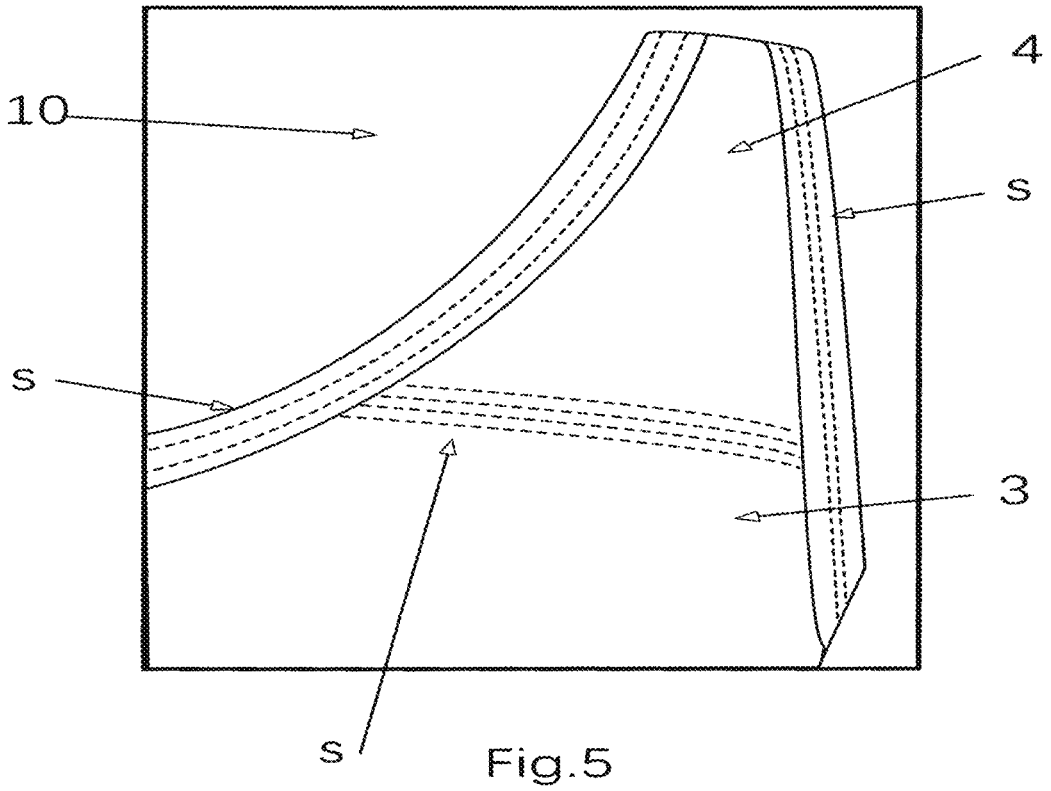
FIG. 5 is an enlarged view of a portion of the shapewear garment (Part A) shown in FIG. 2 illustrating one of the shoulder straps of the shapewear garment.

Referring to FIG. 5, each strap portion 4 of the shoulder straps is preferably a shoulder pad formed of two layers of fabric with a filler interposed therebetween for cushioning the pressure applied by the corresponding shoulder strap of the second shapewear garment noted above and further described below. In one exemplary embodiment, the filler is made of foam, such as styrene butadiene rubber (SBR).

In one exemplary embodiment, the shaper shown in FIGS. 1-6 is made of a stretchable fabric using polyester or nylon as a base material combined with spandex in an amount of 15% or higher. The central part 1 of the shaper forms a central reinforcement portion that is configured to flatten the abdomen up to the pelvic zone of the wearer's body. In one embodiment, the central reinforcement portion 1 is a fabric (e.g., polyester fabric) woven with a plain weave that does not stretch four ways (i.e., is not a 4-way stretch fabric). By its configuration and design, as well as the fabric material used, the shaper of FIGS. 1-6 can be easily and rapidly applied to the wearer's body. The shaper of FIGS. 1-6 smoothens rolls on the wearer's body produced by fat of adipose tissue, as well as smoothens the wearer's skin to thereby reduce cellulite.

An exemplary method of fabricating the shaper shown in FIGS. 1-6 is described below with reference to FIG. 17 which is a plan view of the separate pieces 1-7 forming the shaper and illustrates the design or pattern thereof.

Figure 17:
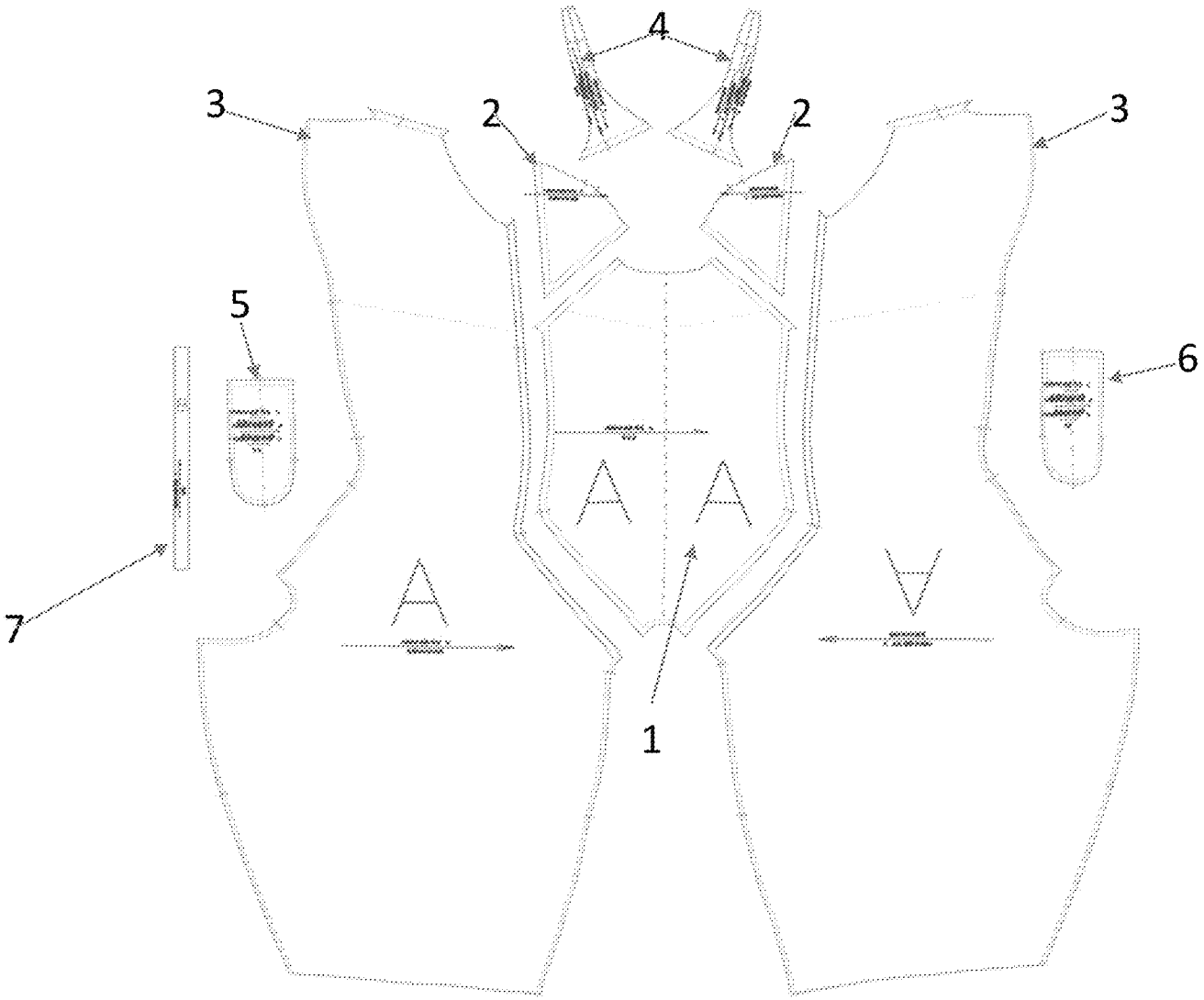
FIG. 17 is a plan view of the separate pieces forming Part A of the shapewear garment system of the invention, and illustrating the design or pattern thereof.

The shaper pattern corresponding to the pattern design shown in FIG. 17 is first printed on pattern paper which is subsequently placed (superimposed) over the selected fabric for cutting. The cutting process is performed by cutting along the lines of the pattern using a metallic cutter or laser to obtain the separate shaper pieces 1-7 shown in FIG. 17. The separately cut pieces 1-7 of the shaper are then prepared for assembly along with the border tapes and adjustable fasteners for the straps.

Figure 4:
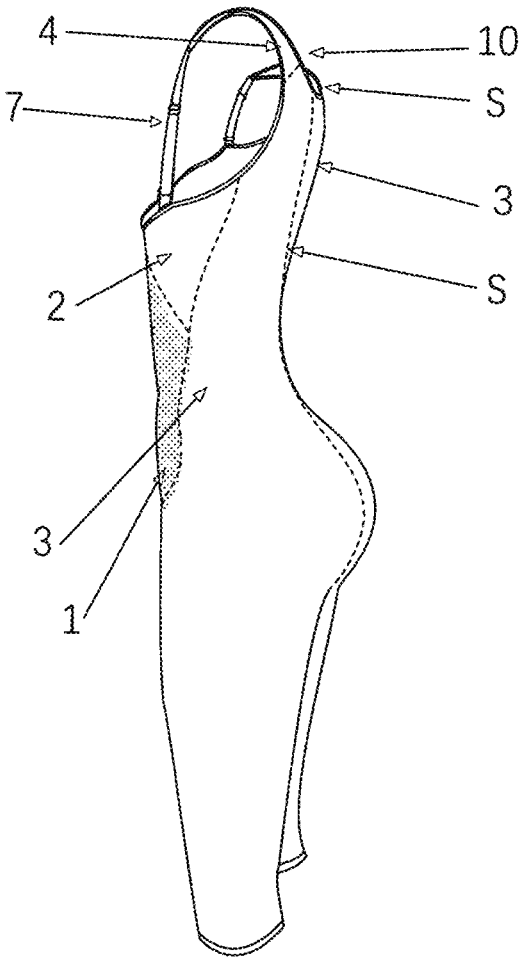
FIG. 4 is a rear perspective view of the shapewear garment shown in FIG. 1.

The central part 1 is sewn to the two top side parts 2, and the left and right side parts 3 are sewn to the central part 1 and top side parts 2. The strap portions 4 are separately assembled by sewing together the two fabric layers with the filler (e.g., SBR) interposed therebetween to form the shoulder pads. Each of the assembled strap portions 4 is then sewn to the corresponding side part 3. The crotch parts 5, 6 are assembled together (e.g., by sewing) one over the other and divided in two parts to form a crotch opening (e.g., to allow the wearer to urinate without the necessity of removing the shaper). The left and right side parts 3 are then joined together along seam S running along the back of the wearer as shown in FIG. 4. The assembled crotch parts 5, 6 are then sewn to the left and right side parts 3, thereby providing the crotch opening. Side edges of each of the left and right side parts 3 are then joined along seam S running along the corresponding leg of the user as shown in FIG. 1. Border tapes are then sewn to lower portions of the left and right side parts 3 and to the top portion of the back to the shoulders corresponding to left and right side parts 3 and strap portions 4. Tapes are then sewn to front, side, back and shoulder portions corresponding to shaper parts 1-4. A clip is then sewn to the central portion of a border of each of the top side parts 2 for releasable connection to the hook portion of the corresponding adjustable fastener 8 as described above. The adjustable fasteners 8 and 9 are then assembled to the strap portion 7 of each of the straps, and the first end of each strap portion 7 is sewn to the corresponding strap portion 4 (FIG. 6).

According to the present invention, the shaper illustrated in FIGS. 1-6 can be used by the wearer as a standalone shaping (foundation) garment to provide the functionalities and benefits as described above. As further described below, the shaper of FIGS. 1-6 is also configured for use as a low compression shaping garment (Part A) that can be easily applied first to the wearer's body to condition the wearer's body for receiving another shaping garment (Part B) in overlying relationship to Part A so that the combination of Part A and Part B applies on the wearer's body a compression higher than the compression applied on the wearer's body when only Part A is applied. As described herein, the combination of Part A and Part B form an integral shapewear garment system as another aspect of the present invention.

As noted above, the shaper (Part A) shown in FIGS. 1-6 is also configured for use in conjunction with another shapewear garment (Part B) to provide a shapewear garment system corresponding to another principal aspect of the present invention. That is, Part B is configured to be applied directly over Part A which is configured to be applied directly over the wearer's body. In the shapewear garment system, Part A functions to condition the wearer's body for receiving Part B. As further described below, due to the material and construction of Part B, without the conditioning effect of Part A on the wearer's body, it would be difficult, if not impossible, to apply (e.g., slide) Part B directly over the wearer's body due to a high resistance generated upon contact of Part B with the wearer's body.

FIGS. 7-10 show a shapewear garment corresponding to Part B of the shapewear garment system according an exemplary embodiment of the present invention. While in FIGS. 7-10 Part B is shown as being applied directly on the mannequin 10, it is understood that this is only for the purpose of illustrating the various structural features of Part B according to the present invention. As noted above, Part B of the shapewear garment system according to the exemplary embodiment of the invention is configured to be applied over Part A in overlying relation thereto which is in turn applied directly over the wearer's body.

Figure 10:
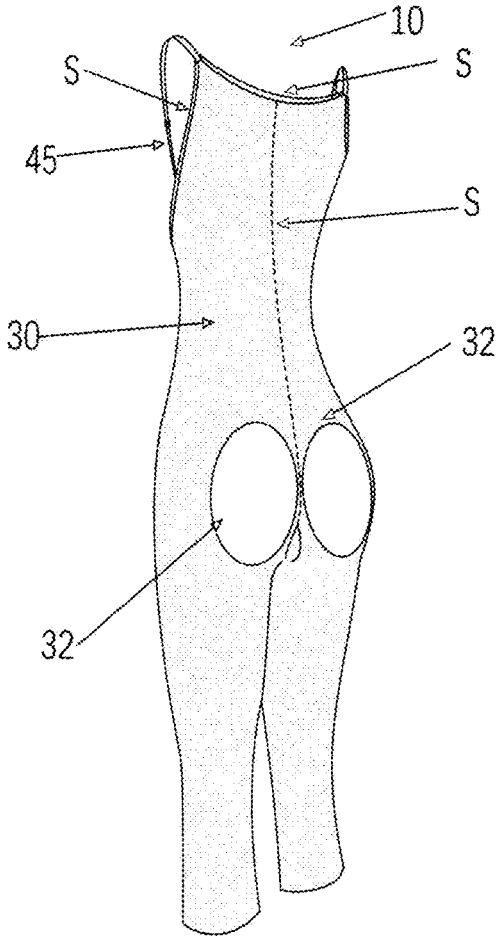
FIG. 10 is a rear perspective view of the shapewear garment shown in FIG. 7.
Figure 11:
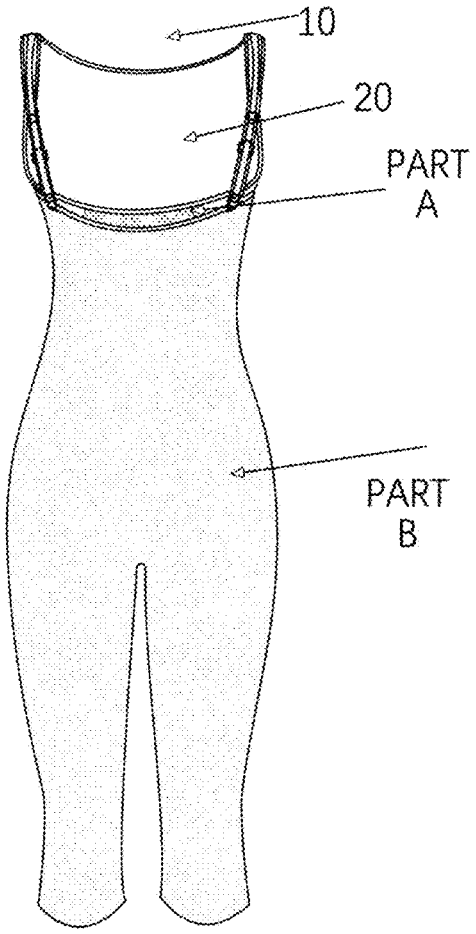
FIG. 11 is front view of the shapewear garment system (Parts A and B) during use.

Part B according to the exemplary embodiment is formed of a main part 30 of unitary construction (i.e., not of multipiece construction) configured to contain the back, waist, buttocks, and hips of the wearer. The main part 30 includes two integral leg portions configured to encircle the respective leg of the wearer and extend below the knee. An upper portion of a front side of main part 30 (FIG. 7) is also configured so as to leave the breasts of the wearer exposed during use. Separate from main part 30, Part B also contains crotch parts 35, 40 and two shoulder straps 45. Crotch parts 35, 40 are connected together to define a crotch opening through Part B configured to be aligned with the crotch opening defined by crotch parts 5, 6 of Part A during use of the shapewear garment system. A region of the rear side of the main part 30 is provided with openings 32 to expose the wearer's buttocks, as shown in FIGS. 8 and 10.

Figure 7:
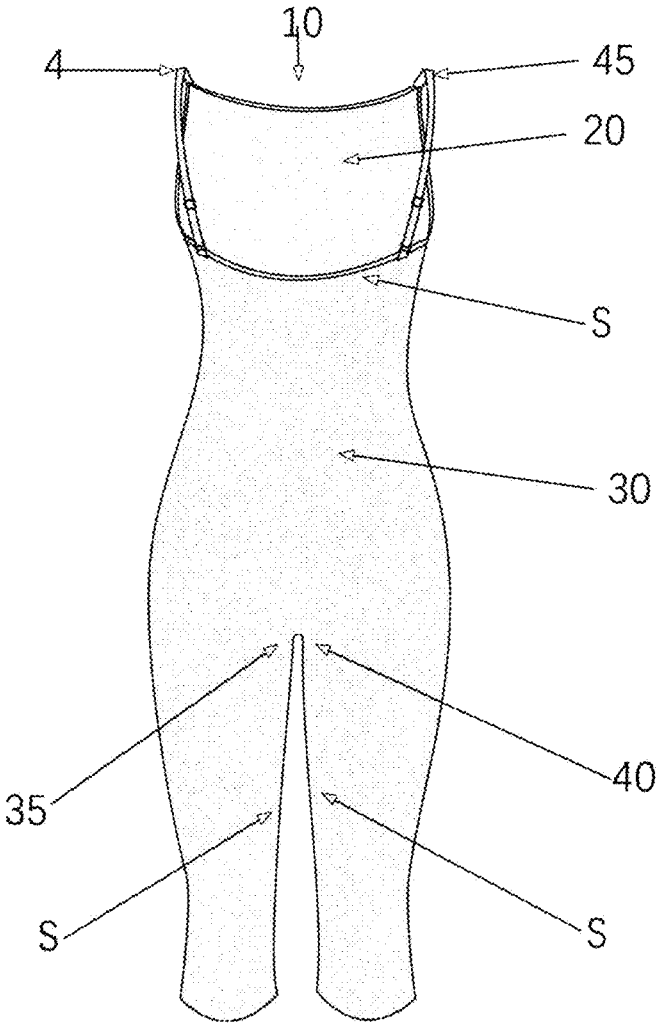
FIG. 7 is a front view of a shapewear garment corresponding to another part (Part B) of the shapewear garment system according to the present invention. Part B is in configured for use in combination with Part A shown in FIGS. 1-6.
Figure 8:
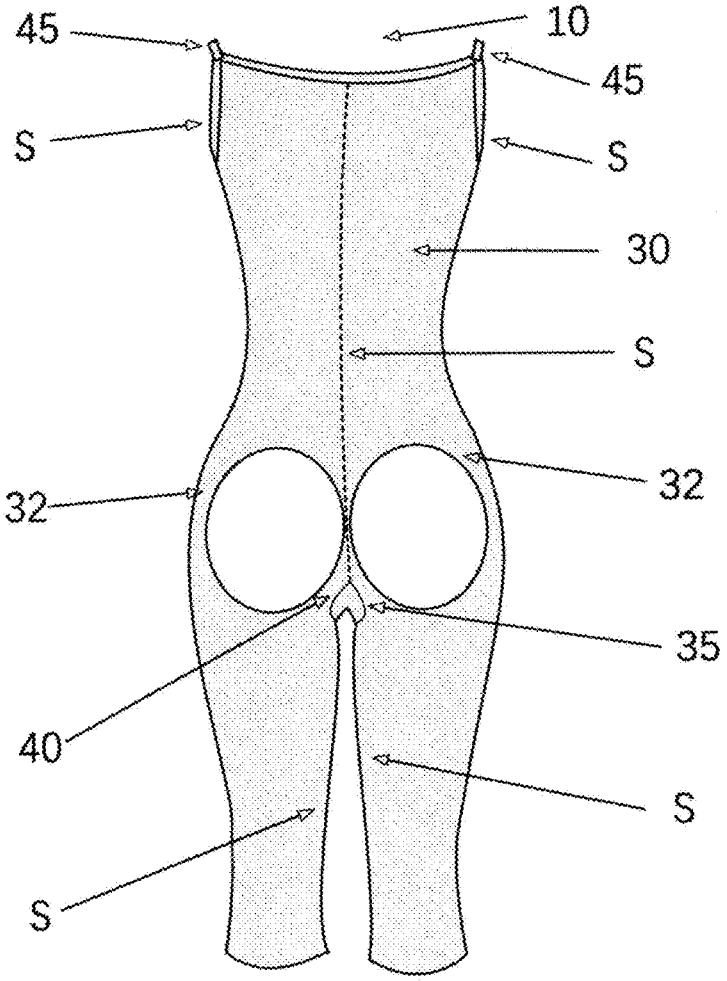
FIG. 8 is a rear view of the shapewear garment shown in FIG. 7.
Figure 9:
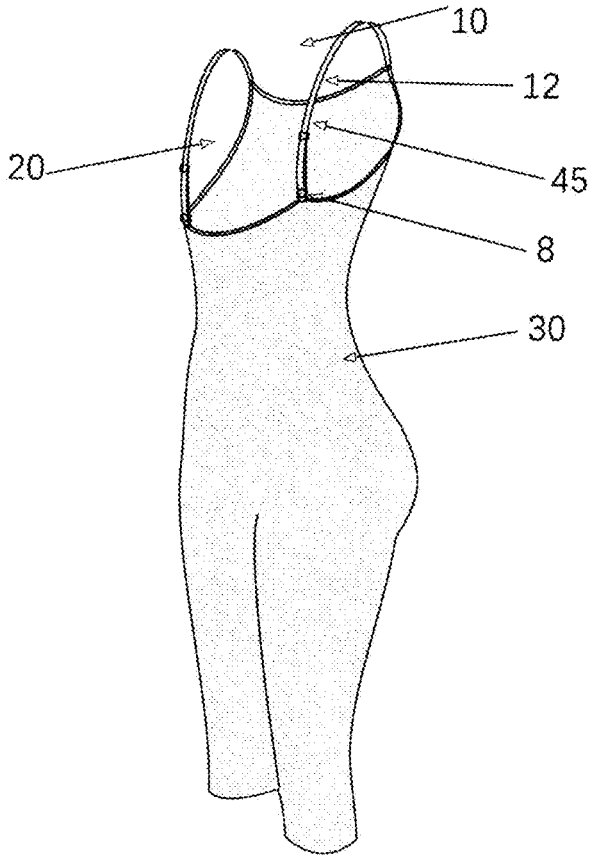
FIG. 9 is a front perspective view of the shapewear garment shown in FIG. 7.

Each of the straps 45 has a first end connected (e.g., sewn) to an upper portion of the rear side of the main part 30 (FIGS. 8, 10), and a second end for releasable connection to an upper portion of the front side of the main part 30 (FIGS. 7 and 9). Each of the straps 45 is provided with adjustable fasteners 8, 12 (FIGS. 9, 15) for adjusting the length of the strap 45 during use. Adjustable fastener 8 is provided at the second end of the strap 45 and has the same construction as adjustable fastener 8 described above for Part A. The hook portion of adjustable fastener 8 is configured for releasable connection to a clip that is provided (e.g., sewn) to the upper portion of the front side of the main part 30. Adjustable fastener 12 is similar in construction to adjustable fastener 9 described above for Part A, except that it does not contain the hook portions 9A, 9B. That is, adjustable fastener 12 only has two adjoining closed loop portions as described above for portions 9C, 9D of adjustable fastener 9.

In an exemplary embodiment, Part B is made of a stretchable fabric using polyester or nylon as a base material combined with spandex in an amount of 30% or higher.

An exemplary method of fabricating Part B of the shapewear garment system shown in FIGS. 7-10 is described below with reference to FIG. 18 which is a plan view of the separate pieces 30, 35, 40 and 45 forming Part B and illustrates the design or pattern thereof.

Figure 18:
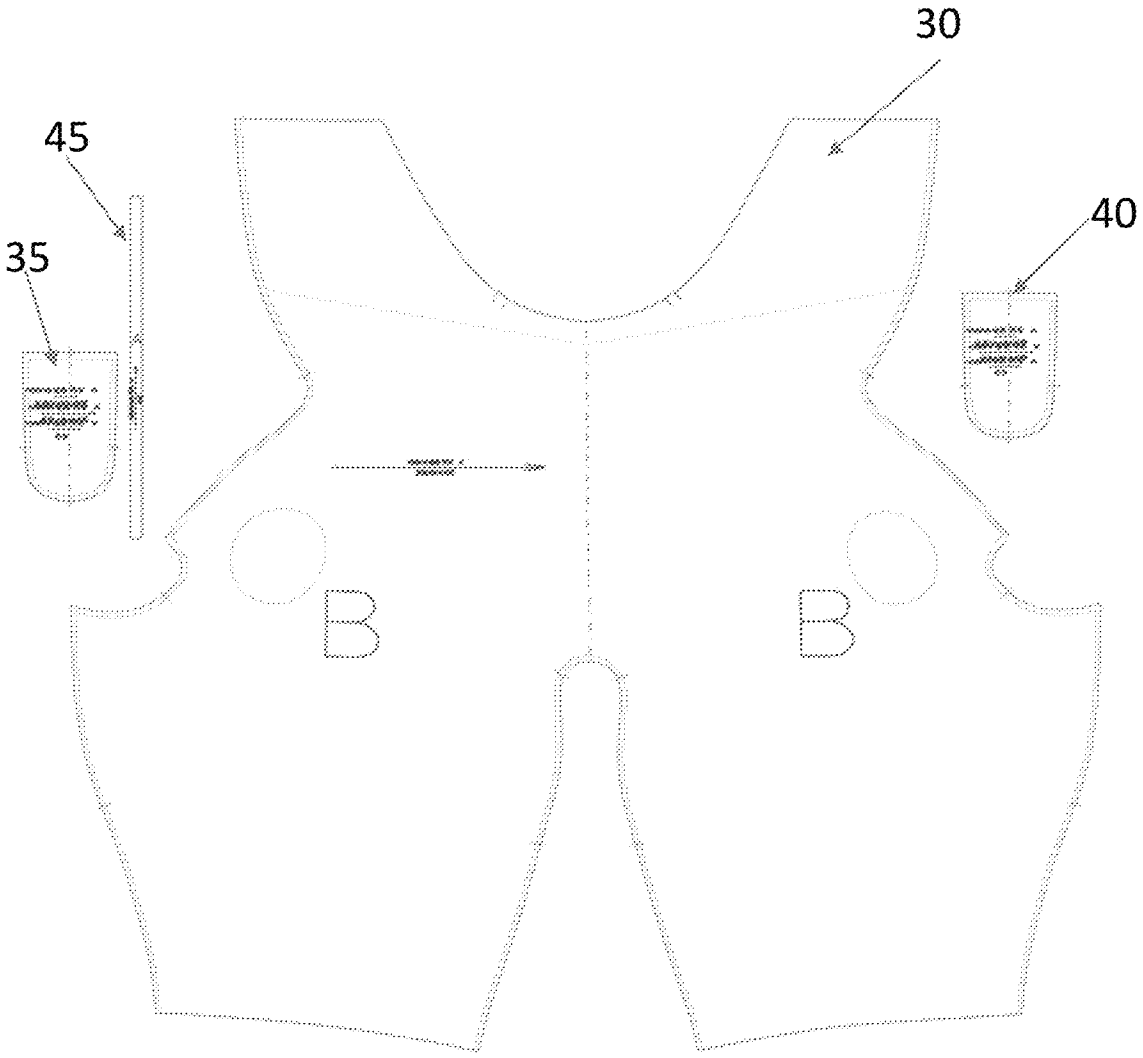
FIG. 18 is a plan view of the separate pieces forming Part B of the shapewear garment system of the invention, and illustrating the design or pattern thereof.

The pattern for Part B corresponding to the pattern design shown in FIG. 18 is first printed on pattern paper which is subsequently placed (superimposed) over the selected fabric for cutting. The cutting process is performed by cutting along the lines of the pattern using a metallic cutter or laser to obtain separate pieces 30, 35, 40 and 45, as shown in FIG. 18, corresponding to the main part 35, crotch parts and shoulder straps of Part B as described above. The separately cut pieces 30, 35, 40 and 45 of Part B are then prepared for assembly along with the border tapes and adjustable fasteners for the straps.

Outer side edges of piece 35 corresponding to the main part of Part B are joined together along a seam S (FIGS. 8, 10). Pieces 35, 40 corresponding to the crotch parts are assembled together (e.g., by stitching) one over the other and divided in two parts to form the crotch opening. The assembled crotch parts 35, 40 are then sewn to the main part 35. Inner edges of piece 35 are then joined along seams S to form the leg portions of Part B (FIGS. 7, 8). Border tapes are then sewn to front, side, back and shoulder portions formed by main part 35. Clips are then sewn to upper portions the main part 35 for releasable connection to respective hook portions of adjustable fasteners 8 as described above. Adjustable fasteners 8 and 12 are then assembled at positions of the straps 45 as shown in FIG. 9, and the first end of each strap 45 is sewn to the corresponding upper portion of the rear side of the main part 30 (FIGS. 8, 10).

FIGS. 11-15 illustrate the shapewear garment system of the present invention during use. The shapewear garment system is formed of two (first and second) shapewear garments, such as Part A and Part B as described above, which are configured to be worn together in overlapping relation to one another over a wearer's body. Part A is configured to be applied directly over the wearer's body, and Part B is configured to be applied directly over Part A, as shown in FIGS. 11-15. When Part A and Part B are assembled in this manner over the wearer's body, the crotch openings of Part A and Part B are aligned with one another.

Figure 15:
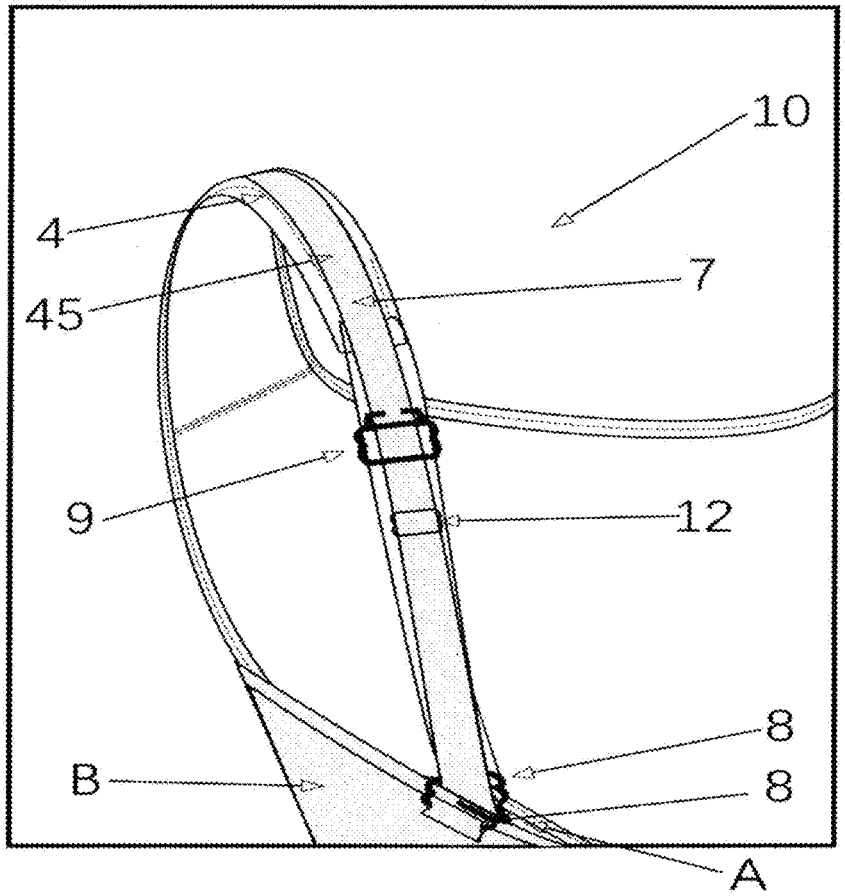
FIG. 15 is an enlarged view illustrating the relative positioning and attachment between strap portions of the shoulder straps of Part A and Part B of the shapewear garment system.

Referring to FIG. 15, when Part B is applied over Part A, straps 45 of Part B rest on respective straps 7 of Part A and pass under hook portions 9A, 9B of respective adjustable fasteners 9. By this arrangement, straps 45 are positioned and guided relative to straps 7 by hook portions 9A, 9B so as to prevent straps 45 from sliding out of position relative to respective straps 7. This effectively prevents unwanted shifting and possible sliding out of position of Part A and Part B relative one another during use by the wearer.

Figure 12:
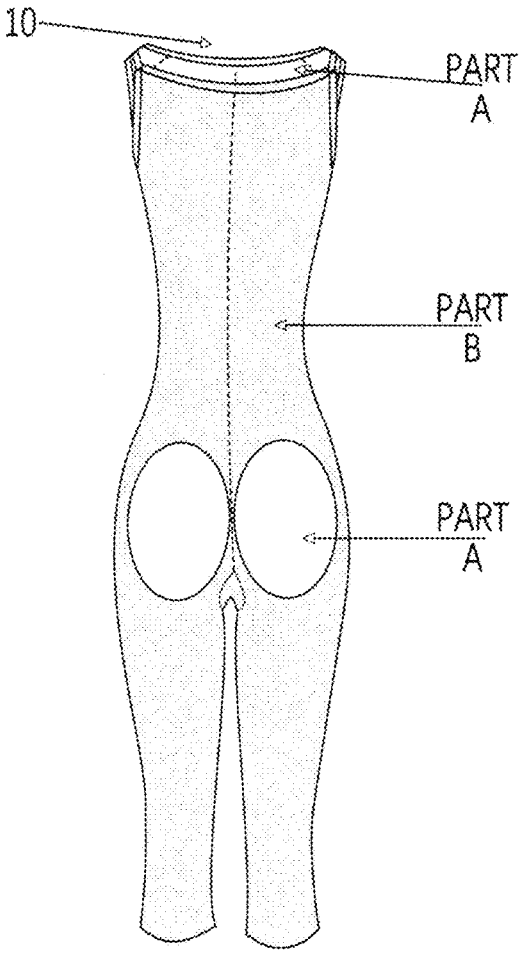
FIG. 12 is a rear view of the shapewear garment system shown in FIG. 11.
Figure 13:
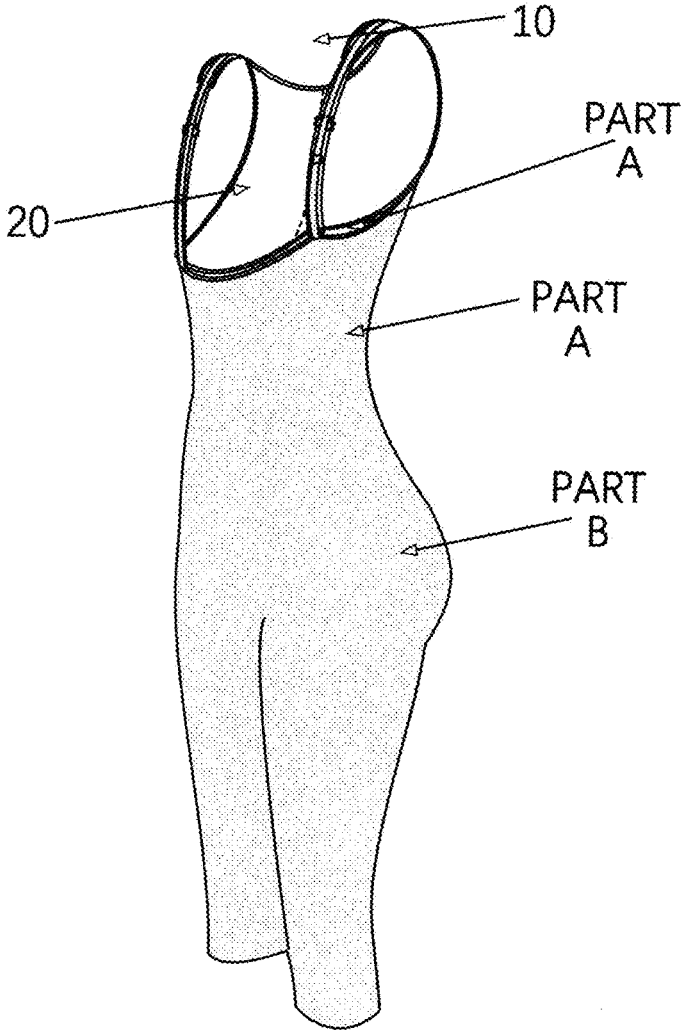
FIG. 13 is a front perspective view of the shapewear garment shown in FIG. 11.
Figure 14:
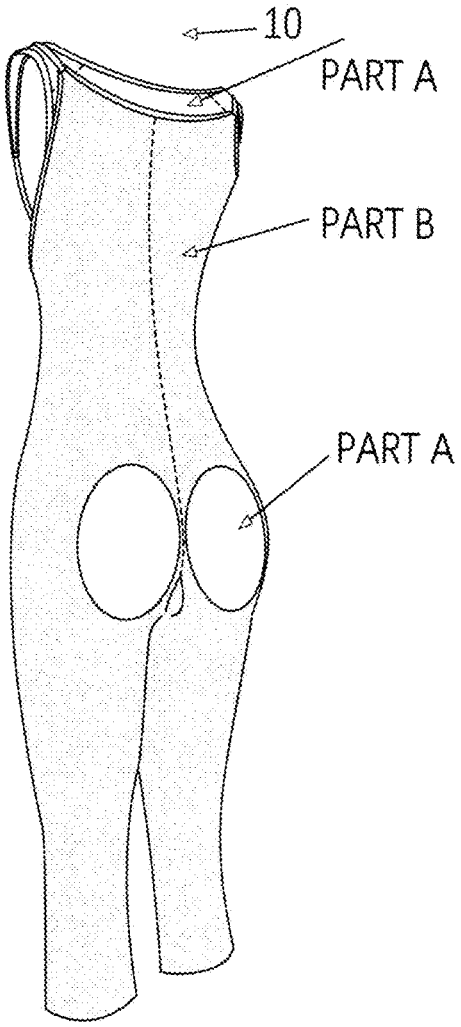
FIG. 14 is a rear perspective view of the shapewear garment shown in FIG. 11.

As shown in FIGS. 12, 14 and 15, when Part B is applied over Part A portions of straps 45 of Part B rest directly on strap portions 4 of Part A defining the shoulder pads as described above. As a result, the shoulder pads of Part A effectively cushion the pressure applied by respective straps 45 of Part B, thereby avoiding discomfort to the wearer's shoulders due to pressure applied by straps 45.

In an exemplary embodiment, Part A is made of a stretchable fabric using polyester or nylon as a base material combined with spandex in an amount of 15% or higher, and Part B is made of a stretchable fabric using polyester or nylon as a base material combined with spandex in an amount of 30% or higher. The central part 1 of Part A forms a central reinforcement portion that is configured to flatten the abdomen up to the pelvic zone of the wearer's body. In one embodiment, the central reinforcement portion 1 is a fabric (e.g., polyester fabric) woven with a plain weave that does not stretch four ways (i.e., is not a 4-way stretch fabric). By this construction, Part A can be easily and rapidly applied to the wearer's body, and functions to effectively smoothen rolls on the wearer's body produced by fat of adipose tissue, as well as smoothens the wearer's skin to thereby reduce cellulite. As such, Part A of the shapewear garment system functions as a priming/primer garment which conditions/prepares the body of the wearer to receive Part B.

The shapewear garment system formed of Part A and B is designed to change the wearer's shape, produce a more fashionable slim figure, and enhance the natural curves of the body. The shapewear garment system is effective in producing a smooth fit that flattens the wearer's figure while maintaining long-term comfort. The shapewear garment systems is characterized by the dual advantage of low compression being applied on the wearer's body when only Part A is applied, whereas high compression is applied on the wearer's body when both Parts A and B are applied on the wearer's body.

According to the present invention, Parts A and B form an integral shapewear garment system in which Part A functions to condition the wearer's body to prepare the wearer's body to receive Part B. That is, while Part A can be used as a standalone shapewear garment, Part B can only be effectively used due to the conditioning of the wearer's body by Part A. In this regard, Part A, functions to prepare or prime the wearer's body to receive Part B, as described above. Using only Part A, the wearer's body is subjected to low compression, whereas the wearer's body is subjected to high compression when both Parts A and B are used. The conditioning effect of Part A allows Part B to be easily applied on and removed from the wearer's body. In this regard, Part A prepares the wearer's body by eliminating friction so that Part B can be gently slid over Part A. That is, without the conditioning effect of Part A on the wearer's body, it would be difficult, if not impossible, to slide Part B directly over the wearer's body due to a high resistance generated upon its contact with the skin of the wearer's body.

During use, the shapewear garment system formed of Parts A and B does not generate marks on the wearer's torso. The shapewear garment system effectively flattens the wearer's abdomen to the pelvic zone, smoothens fat bulges or rolls in the torso, back and leg areas of the wearer's body, and lifts and rounds the wearer's buttocks in a highly effective manner. The material selected for Parts A and B of the shapewear garment systems are preferably is sufficiently thin in order to maintain the wearer's body cool and prevent an increase in the clothing size of the wearer. The shapewear garment system is not noticeable on the user's body, even when worn under tightly adjusting outer clothing.

As described above, Part B can be easily slid over the wearer's body as a result of the conditioning effect by Part A on the wearer's body. Part B is configured to further increase the compression applied on the wearer's body by Part A, giving form to the torso, legs, thighs, hips and buttocks. When applied over Part A, Part B effectively functions to lift the buttocks by applying pressure to areas of the buttocks surrounding the central part of the buttocks already firmed up by Part A, thereby causing the wearer's buttocks to project and achieve enhanced roundness. Part B even further smoothens rolls on the wearer's body produced by fat of adipose tissue as well as cellulite marks. The fabric material forming Part B is characterized by highly thin edges which do not require terminating seams or reinforcements.

In the shapewear garment system described above with reference to FIGS. 11-15, Part A (FIGS. 1-6) has been described with a particular application as a shapewear garment (Part A) that conditions or prepares the body of the user for donning and/or removing another shapewear garment (Part B) of higher compression than Part A, with Part A and Part B being configured to change the wearer's shape, produce a more fashionable slim figure, and enhance the natural curves of the body. In an alternative embodiment, Part A may be configured as a garment for donning and/or removing Part B as a compression garment, such as a medical garment designed specifically for applying continuous pressure to an appendage such as the foot, leg, or arm. In a further alternative embodiment, Part A may be configured as a garment for aiding a diver in donning and removing a wetsuit (Part B).

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but are to be accorded the widest scope consistent with the principles and novel features disclosed herein.

What is claimed is:

1. A shapewear garment system comprising:

a first lower body shapewear garment configured to be worn by a wearer to apply on a body of the wearer a first level of compression, the first lower body shapewear garment configured to be worn around a torso, legs, and buttocks of the wearer;

wherein the first lower body shapewear garment comprises shoulder straps and respective adjustable fasteners for adjusting the shoulder straps during use of the first lower body shapewear garment, wherein each of the adjustable fasteners comprises two adjoining closed loop portions and two hook portions extending from one of the two adjoining closed loop portions, the two adjoining closed loop portions being configured to receive a respective strap portion of one of the shoulder straps of the first lower body shapewear garment for length adjustment thereof during use of the first shapewear garment;

a second lower body shapewear garment configured to be worn by the wearer over the first lower body shapewear garment, so that, the combination of the first and second lower body shapewear garments apply on the body of the wearer a second level of compression higher than the first level of compression, the second lower body shapewear garment configured to be worn around the torso, legs, and buttocks of the wearer; and wherein the two hook portions are configured to position and guide a shoulder strap of the second lower body shapewear garment over the corresponding strap portion of the one of the shoulder straps of the first shapewear garment for preventing the shoulder strap of the second lower body shapewear garment from sliding out of position relative to the respective strap portion of the none of the shoulder straps of the first lower body shapewear garment.

2. The shapewear garment system according to claim 1, wherein the first lower body shapewear garment conditions the body of the wearer to receive the second lower body shapewear garment such that the second lower body shapewear garment cannot be applied on the body of the wearer without the first lower body shapewear garment first being applied on the body of the wearer.

3. The shapewear garment system according to claim 1, wherein the first lower body shapewear garment is made of a stretchable fabric of polyester or nylon as a base material combined with spandex in an amount of 15% or higher, and wherein the second lower body shapewear garment is made of a stretchable fabric of polyester or nylon as a base material combined with spandex in an amount of 30% or higher.

4. The shapewear garment system according to claim 3, wherein the first lower body shapewear garment has a central reinforcement portion configured to flatten an abdomen of the wearer up to a pelvic zone of the wearer's body.

5. The shapewear garment according to claim 4, wherein the central reinforcement portion is made of a fabric woven with a plain weave that does not stretch four ways.

6. The shapewear garment system according to claim 1, wherein the first lower body shapewear garment has a central reinforcement portion configured to flatten an abdomen of the wearer up to a pelvic zone of the wearer's body.

7. The shapewear garment system according to claim 6, wherein the central reinforcement portion is made of a fabric woven with a plain weave that does not stretch four ways.

8. The shapewear garment system according to claim 1, wherein the first and second lower body shapewear garments are made of a stretchable fabric containing different amounts of spandex.

9. A shapewear garment system comprising:

a first lower body shapewear garment configured to be applied directly in contact with a body of the wearer for applying a first level of compression to the body of the wearer, the first lower body shapewear garment configured to be worn around a torso, legs, and buttocks of the wearer;

wherein the first lower body shapewear garment comprises shoulder straps and respective adjustable fasteners for adjusting the shoulder straps during use of the first lower body shapewear garment: wherein each of the adjustable fasteners comprises two adjoining closed loop portions and two hook portions extending from one of the two adjoining closed loop portions, the two adjoining closed loop portions being configured to receive a respective strap portion of one of the shoulder straps of the first lower body shapewear garment for length adjustment thereof during use of the first lower body shapewear garment;

a second lower body shapewear garment configured to be applied directly on the first lower body shapewear garment so that the combination of the first and second lower body shapewear garments apply on the body of the wearer a second level of compression higher than the first level of compression, the second lower body shapewear garment configured to be worn around the torso, legs, and buttocks of the wearer; and and wherein the two hook portions are configured to position and guide a shoulder strap of the second lower body shapewear garment over the corresponding strap portion of the one of the shoulder straps of the first lower body shapewear garment for preventing the shoulder strap of second lower body shapewear garment from sliding out of position relative to the corresponding strap portion of the one of the shoulder straps of the first lower body shapewear garment.

10. The shapewear garment system according to claim 9, wherein the first lower body shapewear garment contains spandex in an amount of 15% or higher; and wherein the second lower body shapewear garment contains spandex in amount of 30% or higher.

11. The shapewear garment system according to claim 10, wherein the first lower body shapewear garment is configured to condition the wearer's body to receive the second lower body shapewear garment.

12. The shapewear garment according to claim 9, wherein the second lower body shapewear garment cannot be applied on the wearer's body without the conditioning by the first lower body shapewear garment.

13. The shapewear garment system according to claim 9, wherein the first lower body shapewear garment is configured to condition the wearer's body to receive the second lower body shapewear garment.

14. The shapewear garment system according to claim 9, wherein the first lower body shapewear garment is made of a stretchable fabric of polyester or nylon as a base material combined with spandex in amount of 15% or higher; and wherein the second lower body shapewear garment is made of a stretchable fabric of polyester or nylon as a base material combined with spandex in an amount of 30% or higher.

15. The shapewear garment system according to claim 9, wherein the first lower body shapewear garment has a central reinforcement portion configured to flatten an abdomen of the wearer up to a pelvic zone of the wearer's body; and wherein the central reinforcement portion is made of a fabric woven with a plain weave that does not stretch four ways.

16. The shapewear garment system according to claim 9, wherein the first and second lower body shapewear garments are made of a stretchable fabric containing different amounts of spandex.

17. The shapewear garment system according to claim 16, wherein the first lower body shapewear garment is configured to condition the wearer's body to receive the second lower body shapewear garment.

* * * * *